US006322208B1

(12) United States Patent
Bugner et al.

(10) Patent No.: US 6,322,208 B1
(45) **Date of Patent: *Nov. 27, 2001**

(54) TREATMENT FOR IMPROVING PROPERTIES OF INK IMAGES

(75) Inventors: Douglas E. Bugner; Xin Wen, both of Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/133,080

(22) Filed: Aug. 12, 1998

(51) Int. Cl.[7] ..... B41J 2/01
(52) U.S. Cl. ..... 347/104; 399/335
(58) Field of Search ..... 347/104, 101, 347/96, 103; 399/335, 336, 340, 341; 101/3.1

(56) References Cited

U.S. PATENT DOCUMENTS

| | | | |
|---|---|---|---|
| 4,303,924 | 12/1981 | Young, Jr. . | |
| 4,694,302 | 9/1987 | Hackleman et al. . | |
| 4,833,486 | 5/1989 | Zerillo . | |
| 4,978,969 | 12/1990 | Chieng . | |
| 5,275,646 | 1/1994 | Marshall et al. . | |
| 5,598,196 | 1/1997 | Braun . | |
| 5,605,750 | 2/1997 | Romano et al. . | |
| 5,611,847 | 3/1997 | Guistina et al. . | |
| 5,633,668 | 5/1997 | Schwiebert et al. . | |
| 5,635,969 * | 6/1997 | Allen | 347/96 |
| 5,670,187 | 9/1997 | Kashiwazaki et al. . | |
| 5,679,139 | 10/1997 | McInerney et al. . | |
| 5,679,141 | 10/1997 | McInerney et al. . | |
| 5,679,142 | 10/1997 | McInerney et al. . | |
| 5,698,018 | 12/1997 | Bishop et al. . | |
| 5,722,017 * | 2/1998 | Caruthers, Jr. et al. | 399/238 |
| 5,751,317 * | 5/1998 | Peeters et al. | 347/65 |
| 5,923,356 * | 7/1999 | Gibson et al. | 341/131 |
| 5,975,672 * | 11/1999 | Wen | 347/15 |
| 5,988,791 * | 11/1999 | Miyashita et al. | 347/43 |
| 6,046,822 * | 4/2000 | Wen et al. | 358/1.9 |
| 6,054,246 * | 4/2000 | Bhatt et al. | 430/151 |

FOREIGN PATENT DOCUMENTS

| | | |
|---|---|---|
| 488530 A2 | 10/1991 | (EP) . |
| 533168 A1 | 9/1992 | (EP) . |
| 776950 A2 | 11/1996 | (EP) . |

* cited by examiner

*Primary Examiner*—John S. Hilten
*Assistant Examiner*—Darius N. Cone
(74) *Attorney, Agent, or Firm*—Raymond L. Owens

(57) ABSTRACT

Apparatus for forming an ink image with improved image properties on a receiver in response to a digital image includes an ink jet print head for delivering ink to a receiver to form an image. Relative movement is provided between the receiver and the print head and the ink jet print head is actuated in accordance with the digital image so that the print head transfers ink to the receiver to form the ink image corresponding to the digital image. Replaceable receiver treatment device treats the receiver or the ink image to improve selective aspects of image properties.

7 Claims, 3 Drawing Sheets

TREATMENT FOR IMPROVING PROPERTIES OF INK IMAGES

CROSS REFERENCE TO RELATED APPLICATIONS

Reference is made to commonly assigned U.S. patent application Ser. No. 08/934,370, filed Sep. 19, 1997 entitled "Ink Jet Printing with Radiation Treatment" and U.S. patent application Ser. No. 08/961,058, filed Oct. 30, 1997, entitled "Apparatus For Printing Proof Image and Producing Lithographic Plate". The disclosure of these related applications are incorporated herein by reference.

FIELD OF THE INVENTION

The present invention relates to an ink jet printing apparatus having a replaceable treatment device for ink images.

BACKGROUND OF THE INVENTION

Ink jet apparatus produces images on a receiver by ejecting ink drops onto the receiver in an imagewise fashion. To improve the quality, physical durability, and stability of the printed image, it is often necessary provide treatment of the receiver or ink spots on the receiver prior to or after the ink drops are placed onto the ink receiver. For instance, U.S. Pat. No. 5,635,969 discloses a print head that conditions the ink receiver by ejecting a treatment fluid to the receiver before printing. The treatment fluid on the receiver helps to immobilize the ink spots printed on the receiver, thereby improving the quality and stability of the print. U.S. Pat. No. 5,633,668 teaches an ink jet printer having a heater for heating the receiver prior to printing to reduce the dry time of the printed ink image.

SUMMARY OF THE INVENTION

An object of this invention is to provide ink jet printing apparatus which treats the receiver or ink image for enhancing image properties.

A further object of this invention is to provide ink jet apparatus that can selectively improve different aspects of the image properties in response to the requirements of specific applications.

These objects are achieved by apparatus for forming an ink image with improved image properties on a receiver in response to a digital image, comprising:

a) ink jet print head means for delivering ink to a receiver to form an image;

b) means for providing relative movement between the receiver and the print head means;

c) means for actuating the ink jet print head means in accordance with the digital image so that the print head means transfer ink to the receiver to form the ink image corresponding to the digital image; and d) replaceable receiver treatment means for treating the receiver or the ink image to improve selective aspects of image properties.

ADVANTAGES

A feature of the present invention is that the ink jet printing apparatus is compatible with different types of receiver treatment devices such as a radiation source, a heat source, an electric fan, or a fluid ejection head such as a spray bar or an ink jet print head. Many different aspects of the image properties can be improved as a result.

DETAILED DESCRIPTION OF THE INVENTION

The present invention is described with relation to an ink jet printing apparatus having a modular unit adapted for improved image properties of the printed image. In the present invention, the term "image properties" includes the properties related to the ink dot formation such as dot size, dot gain, and shapes. The image properties also includes image stability and durability of the ink image.

Figure 1:
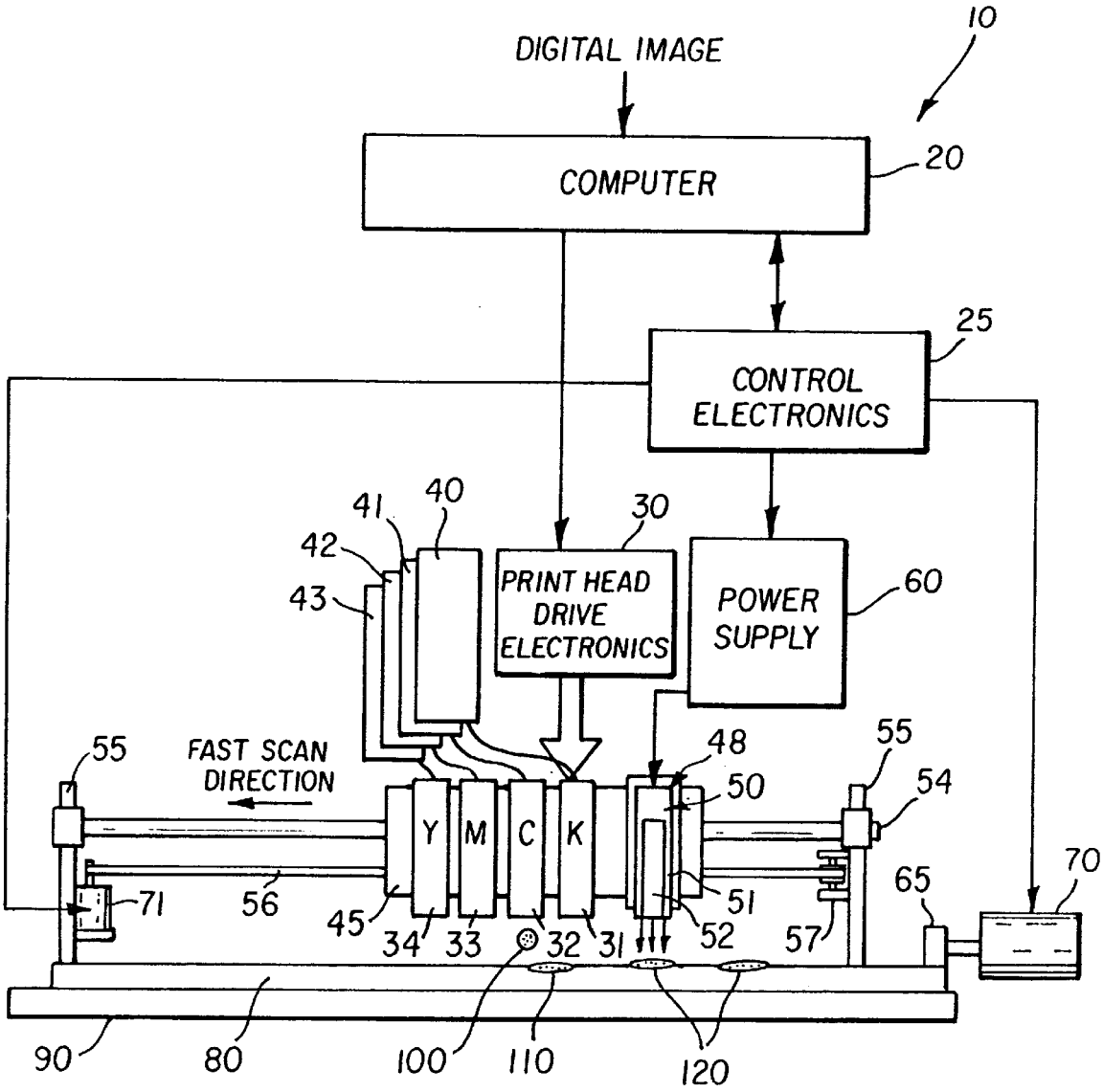
FIG. 1 is a schematic diagram of an ink jet printing apparatus in accordance with the present invention.

Referring to FIG. 1, an ink jet printing apparatus 10 is shown to comprise a computer 20, control electronics 25, print head drive electronics 30, ink jet print heads 31–34 for printing black ink (K), cyan ink (C), magenta ink (M), and yellow ink (Y), and a plurality of ink reservoirs 40–43 for providing respective colored inks to the print heads 31–34. The ink jet printing apparatus 10 further includes a modular unit 48, a power supply 60 connected to the modular unit 48, a receiver transport motor 70, an ink receiver 80, and a platen 90. The power supply is actuated by the control electronics 25 and provides different control signals to the modular unit 48 depending upon which replaceable treatment device is used. A user will input to the computer 20 information as which replaceable treatment device is to be used. The modular unit 48 can receive different replaceable treatment devices, as described below. However, the modular unit 48 will be understood to include structure for receiving different treatment devices so that can be operated by the power supply 60. The print heads 31–34 are fixed to a holder 45 which can be translated by a print head translation motor 71 along the gliding rail 54 in the fast scan direction (as indicated in FIG. 1 by the arrow). The gliding rail is supported by supports 55. The print heads 31–15 34, the modular unit 48, and the holder 45 are transported by several mechanisms, shown in FIG. 1. More specifically, there is shown a belt 56, a pulley mechanism 57, and the print head translation motor 71. The print head translation motor 71 can be a stepping motor, or alternatively can be a DC motor with a servo system. The ink receiver 80 is supported by the platen 90. The receiver transport motor 70 provides relative movement between the ink receiver 80 and the ink jet print heads 31–34 with a roller 65 that moves the ink receiver 80 in a direction (i.e. slow scan) orthogonal to the fast scan direction. It will be appreciated that both the receiver transport motor 70 and the print head translation motor 71 are bidirectional so that the print heads 31–34, the modular unit 48, and the ink receiver 80 can be transported back to the starting position.

As shown in FIG. 1, the treatment device is a UV light source 50 that is installed in the modular unit 48 for physical attachment and electrical connections. The modular unit 48 is fixed to a holder 45 and is translated by the print head translation motor 71. The UV light source 50 includes a shield 51 and a UV lamp 52. The UV lamp is shielded in a glass tube that absorbs visible light while permitting the transmittance of UV light. The glass tube also protects the UV lamp from physical damages. A typical compact UV lamp can be 5 inch long, 0.5 inch in diameter, and 70 gram in weight. Such compact UV lamps are available, for example, from Edmund Scientific under the catalogue numbers of C40,759, C40,760, and C40,765 etc. The light weight and the compact size of the compact UV light source 50 permit it to be installed together with the print heads 31–34 on the holder 45.

Still referring to both FIG. 1, the computer 20 controls the control electronics 25 which in turn controls the power supply 60, the receiver transport motor 70 and the print head translation motor 71. The power supply 60 provides an input voltage to the UV light source 50. The computer 20 also controls the print head control electronics 30 which prepares electrical signals to drive the print heads 31–34 according to the data of the digital image. The print heads 31–34 can exist in different forms, for example, piezo-electric or thermal ink jet print head. An example of such a print head is shown in commonly assigned U.S. Pat. No. 5,598,196.

An input digital image can be applied to, or produced in the computer 20. The digital image is processed in the computer 20 by image processing algorithms such as tone scale conversion, color mapping, halftoning etc. The computer 20 sends the signals representing the digital image to the print head drive electronics 30 that in turn prepares electrical signals for the print head 31–34 according to the digital image data. During each printing pass, the computer 20 controls the control electronics 25 to operate the receiver transport motor 70 and the print head translating motor 71. Under the control of the computer, the ink receiver 80 is positioned for a line of image pixels to be formed and then the print head translating motor 71 moves the ink jet print heads 31–34 in a fast scan direction (shown in FIG. 1). The print head drive electronics 30 operates the ink jet print heads 31–34 to deliver ink droplets 100 to the receiving surface of the ink receiver 80. Each printed image can be typically formed by a plurality printing passes. The ink spots 110 on the ink receiver 80 are treated by the UV light source 50 with power being supplied by the power supply 60 also under the control of the control electronics 25.

The ink receiver 80 can be common paper or made of a synthetic material. The receiver can comprise a layer(s) that is porous to the inks, an ink absorbing layer(s), as well as materials with a strong affinity and mordanting effect for the inks. Exemplary receivers are disclosed in U.S. Pat. No. 5,605,750. The printed images can be used for outdoor signages, bill boards, and displays. The present invention also address many other applications in which image durability is required: security printing such as passports or Identification Cards, Compact Disc or Digital Video Disc, pages in a passport, and lithographic printing plates and so on. These applications all require good image durability and stability.

The ink colors compatible with the present invention can include yellow, magenta, cyan, black, red, green, blue, and other colors. Several ink densities can also be used for each color. The inks can include dyes or pigments. In addition to the colorants, the ink formula can include stabilizers, surfactants, viscosity modifiers, humectants and other components. The inks in the present invention can also be colorless or not intended for color visual effects, for example, the inks used for producing lithographic printing plates such as the ink compositions as disclosed in U.S. Pat. No. 4,833,486 and EP 488,530A2. The examples of the colored inks used in this invention are found in U.S. Pat. No. 5,611,847, as well as the following commonly assigned U.S. Pat. Nos. 5,679,139; 5,679,141; 5,679,142; 5,698,018; and U.S. application Ser. No. 09/034,676, filed Mar. 4, 1998, entitled "Pigmented Inkjet Inks Containing Phosphated Ester Derivatives" to Martin; the disclosures of which are incorporated by reference herein.

To be compatible with the UV light source 50 in FIG. 1, the inks stored in the reservoirs 4043 comprise substances curable by UV-irradiation such as photo-initiators and photo-activators. In the present invention, the term cure refers to the processes that harden or solidify the inks in the ink receiver 80, which can be polymerization, reaction, glass transition, and other similar processes. The curing of the inks on the ink receiver 80 greatly improves the physical durability as well as the image stability (such as water fastness and light fastness) of the printed ink image. UV curable inks are known to a person skilled in the art of ink jet printing. A range of commercial monomers, e.g. having acrylic, vinyl or epoxy functional groups, photo-initiators and photo-activators is available and suitable for use in an ink jet formulation, capable of polymerization by UV light. The reaction may proceed through addition polymerization; all reactants are converted to the final polymeric binder, leaving no by-product or trace of liquid. This reaction can proceed in two processes, either by a free-radical mechanism or by the formation of a cationic species, or combination of both processes. UV curable ink compositions can be found in U.S. Pat. No. 4,303,924, U.S. Pat. No. 5,275,646, and EP Patent Publication No. 407054, EP Patent 488,530 A2, and EP Patent 533,168 A1.

Figure 2:
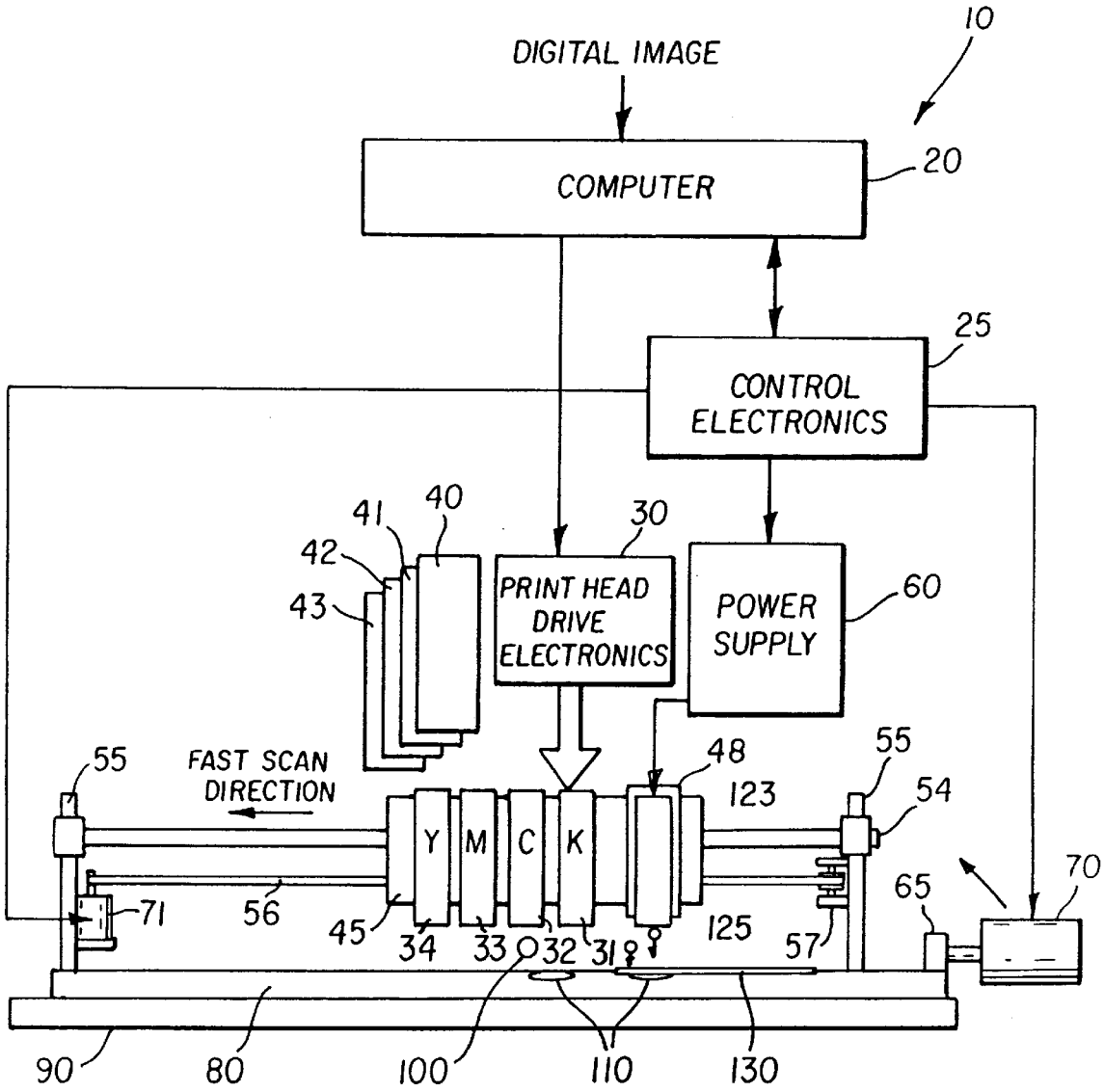
FIG. 2 is a schematic diagram of the ink jet printing apparatus in another embodiment in accordance with the present invention.

FIG. 2 shows another embodiment of the present invention. In the modular unit 48, the replaceable treatment device is a fluid ejection head 123. The fluid ejection head 123 head is connected to the power supply 60. Different treatment fluids can be used for improving different aspects of printing properties. Fluid treatment can be applied to a receiver before an ink image is printed, or to an ink image on the receiver after it is printed. For example, ink spreading is known to affect the ink dot formation and therefore image properties on plain paper. The dot formation of ink spot 110 can be improved by using more expensive glossy paper that includes special coating layer on the top of the receiver. In accordance with the present invention, the image properties on the ink receiver 80 can be improved by transferring a treatment fluid to the ink receiver 80 prior to printing. For an aqueous ink formulation, the treatment fluid is chosen to be hydrophobic. The dot gain and feathering of the ink dots are significantly reduced, therefore improving the image properties for a wide range of receiver types.

The fluid ejection head 123 can also eject or deliver a treatment fluid in the form of sprayed fluid drops 125, for fixing the colorants in the inks to the receivers. The colorant can be fixed to the receiver by mordanting or chemical reaction with the assistance of the treatment fluid. The compositions of the treatment fluid, the inks and the receiver are optimized for the fixing of the colorant in the receiver. Before printing, the fluid ejection head 123 transfers a treatment fluid containing a polymers and binder material to the ink receiver 80. The ink spots 110 are then placed by print heads 31–34 within the fluid treated area 130 on the ink receiver 80 where the treatment fluid is transferred. The binder material in the treatment fluid helps to bind (and fix) the colorant (dyes or pigment) in the ink to the receiver substrate. It is often desirable to have the polymers in the treatment fluid to have opposite charge to the colorant in the ink. The treatment fluid and ink formulations and receiver compositions are exemplified in U.S. Pat. No. 5,640,187 and European Patent EP 776,950 A2, which are incorporated by reference herein. Another example of reactive ink jets is disclosed in U.S. Pat. No. 4,694,302, which is also incorporated by reference.

Figure 3:
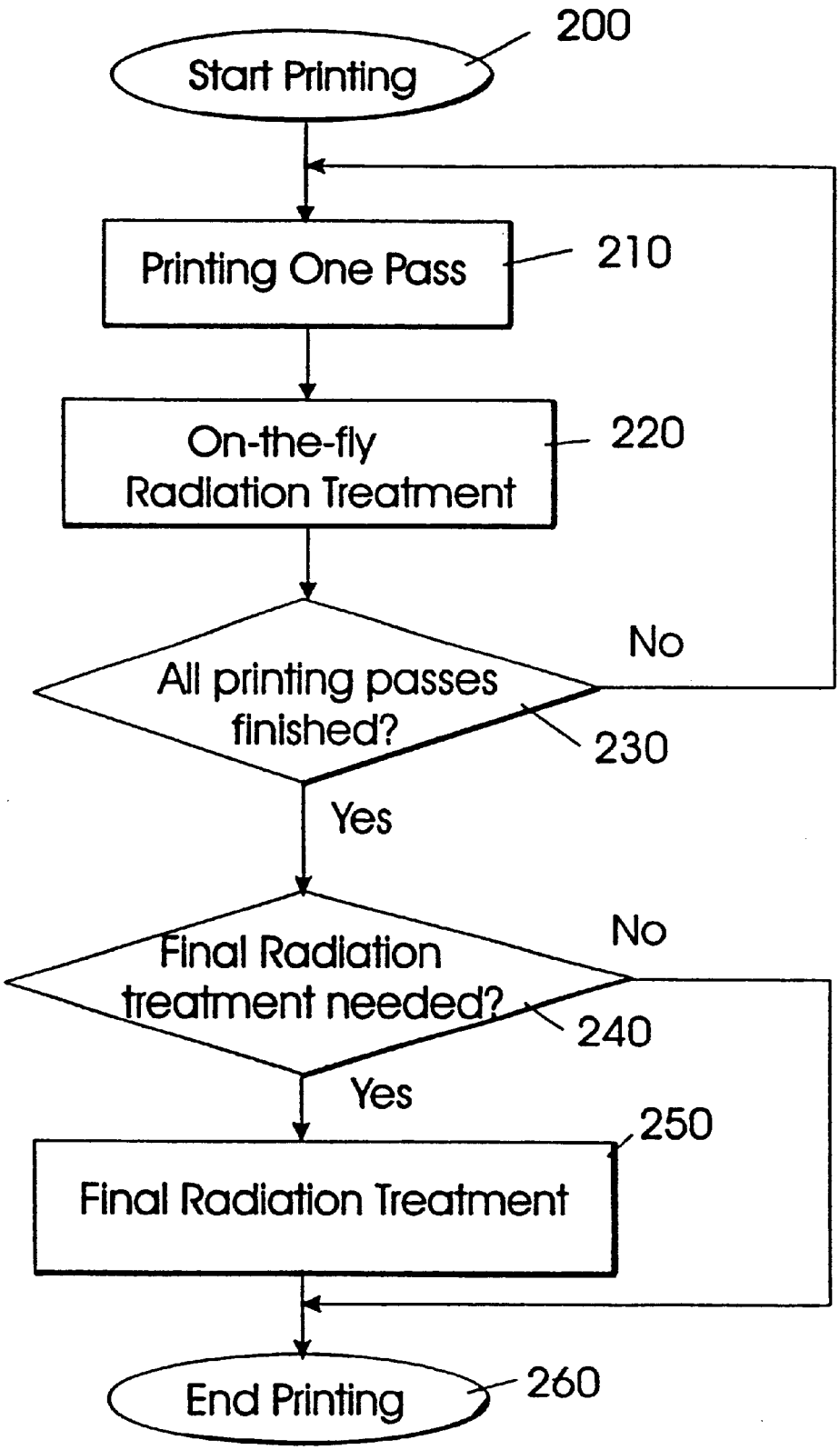
FIG. 3 is a flow chart of the operation of the apparatus of FIG. 1 or FIG. 2 in accordance with the present invention.

The operation in accordance with the present invention is exemplified by the flow chart in FIG. 3 for the ink jet printing apparatus 10 in FIG. 1. The printing operation is started in block 200 in which the computer 20 receives or generates a digital image. The control electronics 25 controls the receiver transport motor 70 to move the ink receiver 80 under the print heads 31–34. In the first printing pass in block 210, the control electronics 25 sends control signals to the print head 30 according to the input digital image to transfer ink drops 100 to the ink receiver 80. As the area marked with the ink spots 110 is transported to the UV light source 50, the control electronics 25 sends control signal to the power supply 60 to activate the UV light source 50 to cure the ink spots 110 on the ink receiver 80 during the first pass, as shown in block 220. The cured ink spots are indicated by the ink spots 120 on the ink receiver 80. Since the receiver treatment by the UV light source 50 (as shown in FIG. 1) in block 220 is implemented on-the-fly, no additional time is required for the printing pass. It will be understood that when different replaceable treatment device is used, the computer 20 will adjust the voltage from the power supply 60 to the modular unit 48. The receiver treatment by the UV light source 50 solidifies the ink spots 110, which prevents ink coalescence in this printing pass as well as coalescence with the ink spots placed in the subsequent printing passes. Next in block 230, a question is asked whether the printing is finished or not, if not, the subsequent printing passes will be in the sequence of ink transfer and receiver treatment in each printing pass in blocks 210 and 220. After all the printing passes are finished, a question is asked in block 240 about whether an additionally final receiver treatment is needed if the answer is no, the printing is finished in block 260. If the answer is yes, a final receiver treatment is performed by the UV light source 50 (as shown in FIG. 1) in block 250. The control electronics 25 causes the receiver transport motor 70 to move the ink receiver 80 below the UV light source 50 that is concurrently activated by the control electronics 25. The last receiver treatment further enhance the curing of all the inks transferred on ink receiver 80. Because the last receiver treatment is not conducted "on-the-fly" during the ink transfer, the receiver treatment time can be optimized by for example, controlling the receiver transport speed.

It will be appreciated that the modular unit 48 in FIGS. 1 and 2 does not have to be mounted on the holder 45 but can be separately moved under the control of the control electronics 25. It is understood that the modular unit 48 in the present invention is also compatible with other forms of receiver treatment. Other radiation devices can include the application of photons at frequencies other than UV or particles such as IR photons or electron beams. For ejecting treatment fluids, a spray bar can be mounted on the modular unit 48. For increasing drying efficiency, a fan or fans can be installed inside modular unit 48 for enhanced air circulation. The ink drying rate can also be increased by a heat source such as an IR lamp. It is further appreciated that more than one receiver treatment devices can be installed in the ink jet printing apparatus 10 in accordance with present invention.

The invention has been described in detail with particular reference to certain preferred embodiments thereof, but it will be understood that variations and modifications can be effected within the spirit and scope of the invention.

PARTS LIST 10 ink jet printing apparatus
20 computer
25 control electronics
30 print head drive electronics
31 ink jet print head
32 ink jet print head
33 ink jet print head
34 ink jet print head
40 ink reservoir
41 ink reservoir
42 ink reservoir
43 ink reservoir
45 holder
48 modular unit
50 UV light source
51 shield
52 UV lamp
54 gliding rail
55 support
56 belt
57 pulley mechanism
60 power supply
65 roller
70 receiver transport motor
71 print head translation motor
80 ink receiver
90 platen PARTS LIST (con't)

100 ink droplets
110 ink spot
120 cured ink spot
123 fluid ejection head
125 sprayed fluid drops
130 fluid treated area
200 start printing block
210 printing one pass block
220 on-the-fly receiver treatment block
230 all the printing passes finished? block
240 final receiver treatment needed? block
250 final receiver treatment block
260 end printing

What is claimed is:

1. Apparatus for forming an ink image with improved image properties on a receiver in response to a digital image, comprising:

a) ink jet print head means for delivering ink to a receiver to form an image;

b) means for providing relative movement between the receiver and the print head means;

c) means for actuating the ink jet print head means in accordance with the digital image so that the print head means transfer ink to the receiver to form the ink image corresponding to the digital image; and d) replaceable receiver treatment means for permitting the selectable use of different treatment devices for treating the receiver or the ink image to improve selective aspects of ink image properties.

2. The apparatus of the claim 1 wherein one of the treatment devices includes a radiation source.

3. The apparatus of the claim 1 wherein one of the treatment devices includes a heat source.

4. The apparatus of the claim 1 wherein one of the treatment devices includes a fluid ejection head which ejects treatment fluid onto the receiver or the ink image.

5. The apparatus of the claim 1 wherein the receiver treatment is provided before printing.

6. The apparatus of the claim 1 wherein the receiver treatment is provided after printing.

7. The apparatus of the claim 1 wherein the control means includes means for moving the print head means and the replaceable receiver treatment means relative to the receiver in at least one direction.

* * * * *